United States Patent [19]

Lofthouse

[11] 4,301,001

[45] Nov. 17, 1981

[54] PROCESS FOR CONCENTRATING MICA IN A MIXTURE OF SAND AND MICA

[75] Inventor: Charles H. Lofthouse, Cornwall, England

[73] Assignee: English Clays Lovering Pochin & Company, Limited, St. Austell, England

[21] Appl. No.: 149,649

[22] Filed: May 14, 1980

[30] Foreign Application Priority Data

May 21, 1979 [GB] United Kingdom ..... 17600/79

[51] Int. Cl.[3] ..... B07B 9/00

[52] U.S. Cl. ..... 209/17; 209/158

[58] Field of Search ..... 209/12, 13, 17, 158

[56] References Cited

U.S. PATENT DOCUMENTS

| | | | |
|---|---|---|---|
| 2,490,129 | 12/1949 | Heyman | 209/17 X |
| 2,708,032 | 5/1955 | Heyman | 209/17 |
| 3,374,885 | 3/1968 | Clawson et al. | 209/17 |

*Primary Examiner*—William A. Cuchlinski, Jr.

*Attorney, Agent, or Firm*—Weingram & Klauber

[57] ABSTRACT

A process for concentrating mica in a mixture of sand and mica is disclosed, which comprises introducing the feed mixture of sand and mica into an upper part of a density separating vessel in which is provided a rising current of an aqueous medium, the velocity of the current being uniform or substantially uniform over a horizontal cross-section of the vessel and being such that all but the least buoyant particles of the mixture are held in suspension as a bed which is gently displaced upwards in the vessel by incoming feed mixture; and passing a slurry which overflows from the vessel over a screen having an aperture size in the range from 210 μm to 500 μm (No. 72 mesh to No. 30 mesh B.S sieve), there being retained on the screen a mixture of sand and mica having a higher percentage content of mica, as calculated in the dry state, than the feed mixture. The mica can be concentrated sufficiently to provide a suitable feed for a subsequent froth flotation process which conventionally requires a mica content of at least 25% by weight.

7 Claims, 2 Drawing Figures

PROCESS FOR CONCENTRATING MICA IN A MIXTURE OF SAND AND MICA

Figure 1:
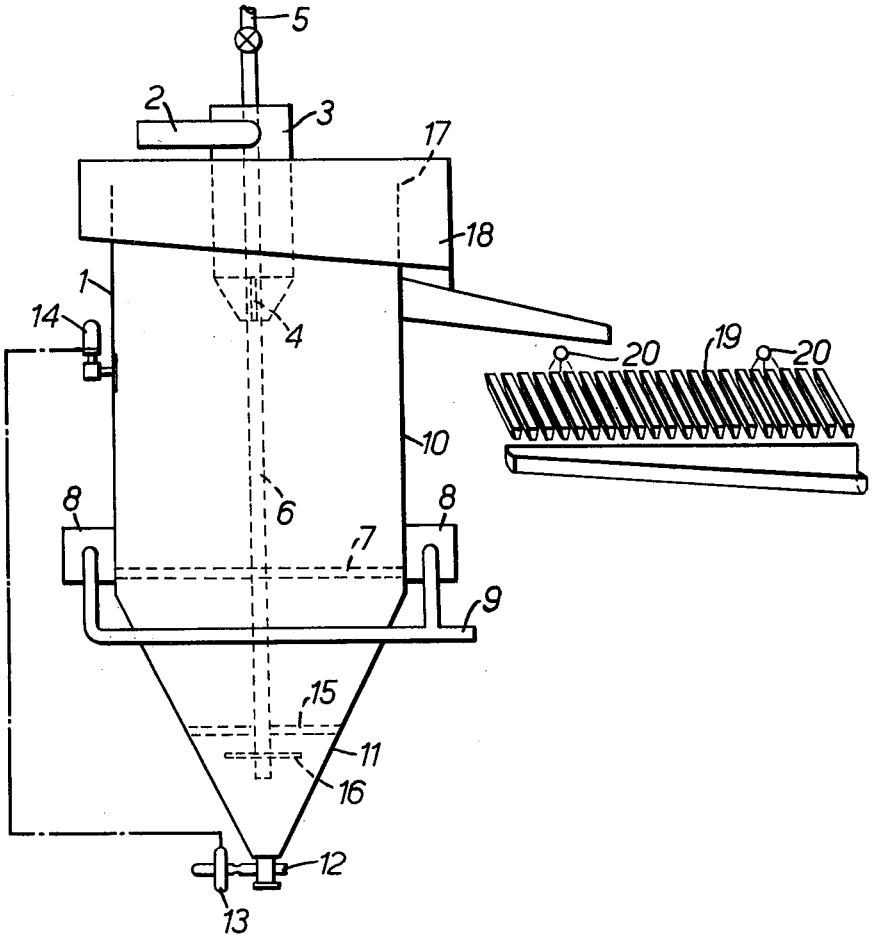

This invention relates to a process for concentrating mica in a mixture of sand and mica.

In a number of mineral extraction processes, in particular in processes for mining kaolin clay, a by-product is a mixture of sand and mica; the sand generally consists predominantly of silica but may contain minor amounts of other minerals such as feldspar and tourmaline. Minor amounts of kaolin may be associated with the mica.

Both sand and mica are potentially useful minerals, but a mixture of sand and mica is virtually useless unless the two components can be separated. For example, sand is an essential ingredient of concrete, but the presence of more than a very small amount of mica makes it unsuitable for this purpose. Also, mica is a useful filler for paints and other compositions, but it must first be separated from the sand.

It is known to separate mica from sand by froth flotation, but in order to obtain an efficient separation by this method it is necessary to provide a feed mixture which has particles of sizes which lie generally in a definite range. Particles larger than the desired maximum size are generally so heavy that they sink regardless of their mineral species and particles finer than the desired minimum size have a greatly increased surface area per unit weight and therefore require correspondingly more reagents if they are to be separated by froth flotation. Also, if the mica is to be recovered in the froth product it is important that the concentration of mica in the feed mixture should be as high as possible, and preferably at least 25% by weight, because otherwise a large number of flotation cells are required per unit weight of substantially pure mica product.

It is relatively easy to separate from a mixture of sand and mica the particles larger than the preferred maximum size for efficient froth flotation, by simple screening; however, it is very much more difficult to remove the particles which are smaller than the desired minimum size by screening because the flaky mica particles tend to blind the apertures of the screen.

According to the present invention, there is provided a process for concentrating mica in a particulate mixture of sand and mica, which process comprises introducing the feed mixture of sand and mica into an upper part of a density separating vessel in which is provided a rising current of an aqueous medium, the velocity of the current being uniform or substantially uniform over a horizontal cross-section of the vessel and being such that all but the least buoyant particles of the mixture are held in suspension as a bed which is gently displaced upwards in the vessel by incoming feed mixture; and passing a slurry which overflows from the vessel over a screen having an aperture size in the range from 210 μm to 500 μm (No. 72 mesh to No. 30 mesh B.S. sieve), there being retained on the screen a mixture of sand and mica having a higher percentage content of mica, as calculated in the dry state, than the feed mixture.

The present invention makes it possible to concentrate mica in a mixture of sand and mica, in order to provide a suitable feed for a subsequent froth flotation process.

The mixture may be introduced into the density separating vessel in a dry or substantially dry state or in suspension in water. If the mixture is introduced as an aqueous suspension the amount of water used is preferably about the minimum which will give a flowable or fluid suspension.

The density separating vessel operates by providing an up-current of aqueous medium, which has a velocity which is substantially uniform over a horizontal cross-section and such that the particles of different buoyancy tend to be suspended at different heights in the vessel.

The buoyancy of a particle depends on such factors as the size, shape and specific gravity of the particle and, under the conditions described above, a stage of equilibrium is reached in which the particles of relatively low buoyancy are suspended at a low level in the vessel and are spaced closely together so that the local rate of flow of the up-current of aqueous medium between the particles is high, and the particles of higher buoyancy are held in equilibrium at higher levels with greater spacing between the particles.

The density of the pulp in equilibrium therefore decreases progressively with increasing height in the vessel. As an aqueous medium to maintain the desired uniform up-current is continuously supplied to the vessel, and as an aqueous medium may continuously be introduced with the feed mixture, pulp must be withdrawn continuously to maintain the state of equilibrium in the vessel. In practice, therefore, an overflow weir is provided at the top of the vessel and a suspension of the more or most buoyant particles is discharged over the weir. An outlet is also provided in a lower part of the vessel for a slurry of the least buoyant particles, and control means are conveniently provided to regulate the rate at which the slurry of least buoyant particles flows through the outlet. The control may be provided manually or automatically, but a preferred method of control utilises a sensing device which monitors or measures the hydrostatic pressure of the pulp at a given level in the vessel and provides signals to open or close the outlet in order to keep the monitored or measured hydrostatic pressure constant. If too much pulp were to be discharged through the outlet, the average size of the particles above the sensing device would be finer than in the desired equilibrium state and the pulp density, and therefore the hydrostatic pressure, would be below the equilibrium value. In contrast, if too little of the pulp were to be discharged through the outlet, coarser particles would accumulate above the sensing device with a consequent increase in pulp density and hydrostatic pressure.

The uniform up-current of aqueous medium is conveniently provided by means of a horizontal array of perforated pipes, the perforations being substantially uniformly distributed throughout the horizontal cross-section. The array of pipes can be supplied with aqueous medium by suitable manifold means. The perforations may be, for instance, on either the upper or the lower side of the pipes; however, the lower side is preferred because in this case the perforations are less likely to become blocked.

The aqueous medium may be water, an aqueous solution or, in some cases, a dilute suspension of a particulate solid material in water.

The feed mixture is preferably introduced at the top of the vessel just below the upper surface of the pulp contained in the vessel. If the feed mixture is introduced as an aqueous suspension, it is preferably fed tangentially into a feed chamber at or near the vertical axis of the vessel, in order to promote mixing of the suspension and to break down any loosely bound agglomerates.

The feed chamber conveniently has an open bottom below the upper surface of the pulp, and vertical baffles are preferably provided at or near the bottom of the feed chamber in order to destroy any circular component of velocity of the feed mixture.

The density separating vessel preferably has an upper portion with vertical walls and a lower portion of inverse conical or pyramidal shape with the outlet at the apex. Advantageously, baffle means are provided near the apex of the lower portion to inhibit the formation of a vortex in the vessel. The array of pipes is conveniently placed at or near the bottom of the upper portion of the vessel.

Preferably the density separating vessel is of the type disclosed in British patent specification No. 1,332,121 which was published on Oct. 3, 1973.

The suspension of more or most buoyant particles which overflows the weir at the top of the vessel is passed over a screen which has an aperture size in the range from 210 to 500 μm preferably from 250 to 350 μm (No. 60 mesh to No. 44 mesh B.S. sieve). Conveniently the screen is of the wedge wire type, i.e. constructed of parallel bars of wedge-shaped cross-section, the broader ends of the wedges being uppermost.

When a mixture of silica sand and mica was introduced into an apparatus of the type described above, while a uniform up-current of water at the appropriate velocity was maintained in the separating vessel, it was found, surprisingly, that the pulp overflowing from the density separating vessel contained not only the finer particles but also the relatively coarse particles of mica which, by reason of their large size and weight, might have been expected to sink to the bottom of the vessel. A possible explanation of this unexpected result is that mica particles are unusually buoyant in relation to their size because of their "plate-like" shape, i.e. their facial area is large compared with their thickness. Mica and silica sand have very similar specific gravities and it was therefore to be expected that the suspension overflowing from the density separating vessel would contain the finer particles of both sand and mica while the coarser particles of both species would sink to the bottom of the vessel and be discharged through the outlet. As indicated above, this did not happen in practice.

The suspension overflowing from the density separating vessel after being passed over a screen having an aperture size in the range from 210 to 500 μm, in order to remove the very fine particles, was found generally to contain more than 25% by weight of mica, based on the dry weight of the mixture, and was therefore a very suitable feed for a froth flotation process for producing substantially pure mica as the froth product.

Figure 2:
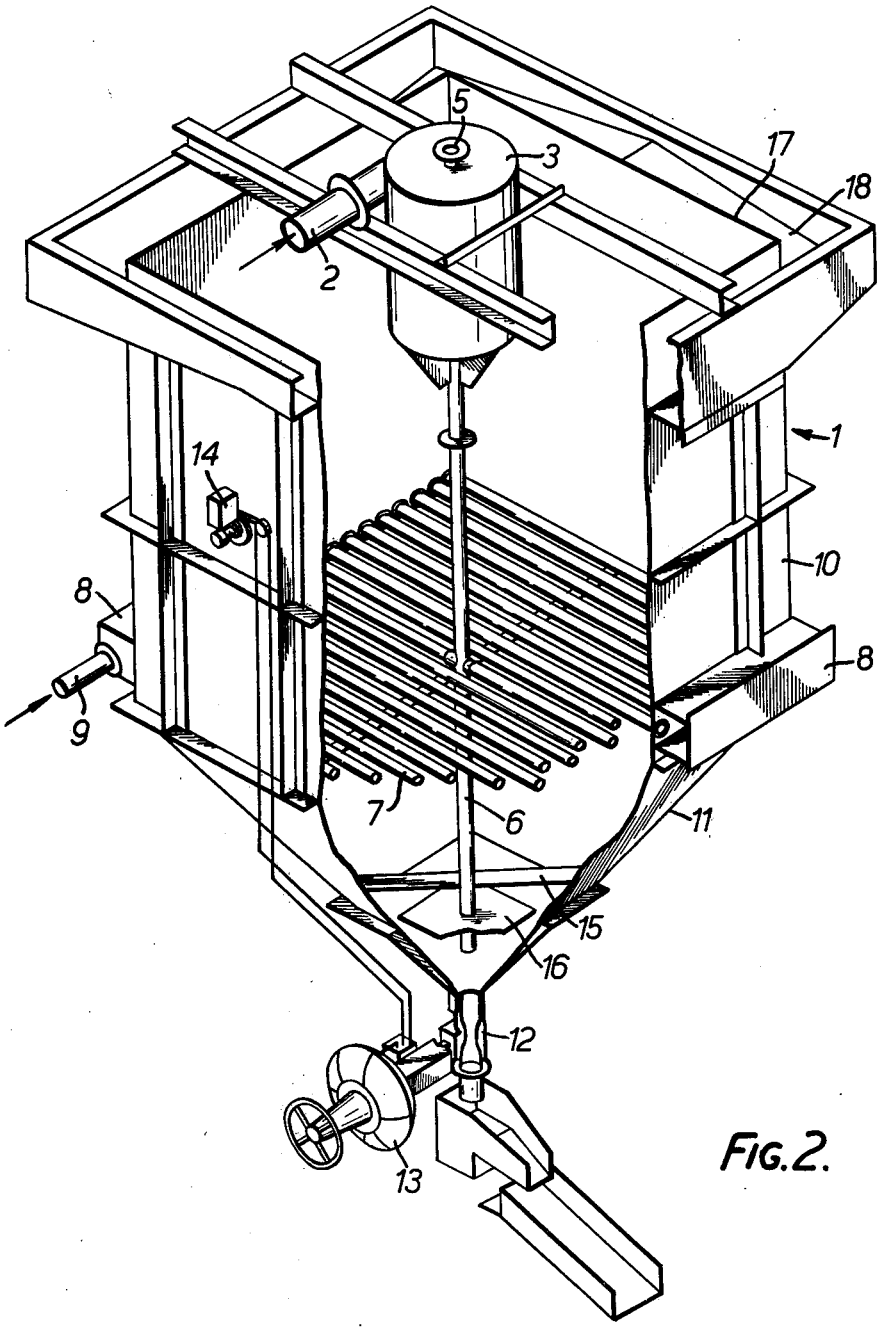

For a better understanding of the present invention and to show how the same may be carried into effect, reference will now be made, by way of example, to the accompanying drawings, in which:

FIG. 1 is a diagrammatic side elevation of an apparatus suitable for carrying out the process of the present invention; and FIG. 2 is an isometric view, partly cut away, of the density separating vessel, which formed part of the apparatus of FIG. 1.

A mixture of sand and mica together with the minimum amount of water required to just form a fluid slurry is introduced into a density separating vessel 1 through a conduit 2 opening tangentially into a feed chamber 3 which is open at the bottom and provided with four vertical baffles 4 in the form of a cross to destroy the circular component of velocity of the suspension. Water is passed through an inlet 5 in the top of the feed chamber and down an axial conduit 6 to the bottom of the separating vessel 1 in order to break up any large agglomerates which may collect there. A uniform up-current of water is provided by means of an array of parallel perforated pipes 7 having apertures (not shown) which open vertically downwards, and water is fed to the pipes by two manifolds 8 from a water supply duct 9. The density separating vessel 1 comprises an upper, vertical sided portion 10 of square cross-section and a lower, inverse rectangular pyramidal portion 11 at the apex of which is provided an outlet guarded by a rubber-lined pinch valve 12 which is automatically controlled by means of a pneumatically-actuated diaphragm 13. A sensor 14 monitors the hydrostatic pressure of the pulp in the separating vessel at the level of the sensor and generates signals which close the valve 12 when the hydrostatic pressure falls below, and opens the valve 12 when it rises above, a desired value. A strut 15 braces the axial conduit 6 near its lower end, and a square plate 16 nearer the lower end of the conduit 6 is provided to inhibit the formation of a vortex and to prevent pulp from passing straight to the outlet.

A suspension of buoyant particles overflows a weir 17 at the top of the separating vessel into a launder 18 and thence over a wedge wire screen 19 (shown in FIG. 2), in which the spacing between the bars is from 210 to 500 μm. Jets of water 20 are provided to wash fine particles through the screen and to remove coarse particles from the top surface of the screen.

The following Examples illustrate the present invention:

EXAMPLE 1

A sample of wet micaceous sand from Brittany was first subjected to sieving with a No. 14 mesh B.S. sieve (nominal aperture 1.2 mm), and the fraction which passed through the sieve was introduced just below the top surface of the pulp contained in a density separating vessel which was generally of the type illustrated and described in British patent specification No. 1,332,121 and which was the same as that illustrated in the drawing accompanying the present application; a constant uniform up-current of water was provided in the density separating vessel. A suspension of the more buoyant particles overflowed continuously into the launder 18 of the vessel while a suspension of the less buoyant particles was discharged intermittently through the valve 12 of the vessel. The feed mixture contained, as determined in the dry state, 15.3% by weight of mica. It was found that 38% by weight of the feed mixture, as calculated in the dry state, found its way to the overflow and that this contained 79.5% by weight of the mica originally present in the feed mixture; the concentration of mica in the dry solids in the overflow was 32% by weight. The overflow suspension was passed over a wedge wire screen having an aperture width of 250 μm (No. 60 mesh B.S. sieve) and the material retained on the screen was collected as the product. This retained material was found to correspond to 31% by weight of the dry feed mixture and to contain 65% by weight of the mica originally present in the feed mixture. The concentration of mica in the dry solids of the fine collected product was 32% by weight and this product was therefore suitable as a feed for a froth flotation process for producing substantially pure mica in the froth product.

EXAMPLE 2

A sample of wet micaceous sand from Brittany was introduced just below the top surface of the pulp contained in a density separating vessel of the type generally disclosed in British patent specification No. 1,332,121 and as illustrated in the drawings accompanying the present application, and was treated in the manner described in Example 1. The feed mixture contained 8.5% by weight of mica. It was found that 27% by weight of the dry feed mixture found its way to the overflow and that this contained 82.6% by weight of the mica originally present in the feed; the concentration of mica in the dry solids of the overflow was 26% by weight. The overflow suspension was divided into three portions which were passed respectively over wedge wire screens having aperture widths of 250 μm, 300 μm and 350 μm (No. 60, No. 52 and No. 44 mesh B.S. sieve respectively). The percentage by weight of the original dry feed material which was retained on the screen, the percentage by weight of mica recovered compared with that in the original feed, and the percentage by weight of the mica in the solid material retained on the screen, for each of the three screens, are set forth in the following Table I:

TABLE I

| | Screen aperture width (μm) | | |
|---|---|---|---|
| | 250 | 300 | 350 |
| % by weight of original feed material retained on screen | 22 | 16 | 8 |
| % by weight of mica recovered compared with mica in original feed (rounded to nearest integer) | 70 | 57 | 38 |
| % by weight of mica in solids retained on screen | 27 | 30 | 40 |

These results show that the percentage concentration of mica in the final product recovered on the screen may be improved by increasing the aperture width of the screen, but at the expense of a reduced overall recovery of mica. All three of the recovered products would be suitable as a feed for a froth flotation process for producing substantially pure mica in the froth product.

EXAMPLE 3

Raw, dry-mined Brittany kaolin was mixed with water in a washmill and the resultant slurry was passed through a succession of screens, the finest of which had an effective aperture size of 4 mm. The material retained on each screen was conveyed to separate sand piles and the slurry passing through the 4 mm screen was subjected to a particle size separation in a drag classifier (as described in "Chemical Engineers Handbook", 5th edition by Robert H. Perry and Cecil H. Chilton, Mc.Graw-Hill Book Company, New York 1973, page 21–48) which yielded a fine fraction consisting predominantly of a suspension of kaolinite which was further beneficiated. The coarse fraction from the classifier was introduced just below the top surface of the pulp contained in a density separating vessel of the type used in Examples 1 and 2. A constant uniform up-current of water was provided in the density separating vessel, and a suspension of the more buoyant particles overflowed continuously into the launder 18 of the vessel while a suspension of the less buoyant particles was discharged intermittently through the valve 12 of the vessel. The overflow suspension was passed over a wedge wire screen having an aperture width of 250 μm, and the material retained on the screen was used as the feed to a froth flotation process for producing substantially pure mica in the froth product. The machine discharge product from the froth flotation process was discarded as waste to a tailings dam and the suspension passing through the wedge wire screen, being comparatively rich in kaolinite, was returned to the drag classifier.

The compositions of the mineral mixture (as calculated in the dry state) in the feed to the density separating vessel, in the overflow and underflow products from the density separating vessel, in the material retained on the 250 μm screen and in the suspension passing through the 250 μm screen were determined by X-ray diffraction. The percentage by weight of the dry original feed material which was present in each of these fractions was determined, and from these results the percentage recovery of mica, quartz and kaolinite in each fraction was calculated.

The results, rounded to the nearest whole percent, are set forth in the following Table II:

TABLE II

| | Density separating vessel | | | 250 μm - screen | |
|---|---|---|---|---|---|
| | Feed | Over-flow | Under-flow | Retained | Passed |
| % by wt. of dry material relative to original dry feed material | 100 | 62 | 38 | 17 | 45 |
| % by wt. of following constituents in dry material at different stages:- | | | | | |
| kaolinite | 28 | 44 | 2 | 27 | 51 |
| mica | 28 | 35 | 17 | 56 | 27 |
| quartz | 41 | 18 | 78 | 14 | 20 |
| feldspar | 2 | 3 | 2 | 3 | 2 |
| tourmaline | 1 | 0 | 1 | 0 | 0 |
| % by wt. recovery of following constituents at different stages:- | | | | | |
| mica | 100 | 77 | 23 | 34 | 43 |
| quartz | 100 | 27 | 73 | 5 | 22 |
| kaolinite | 100 | 97 | 3 | 15 | 82 |

The feed to the froth flotation process was thus a mineral mixture 56% of the dry weight of which consisted of mica; thus 34% by weight of the original mica was recovered for use in the feed to the froth flotation process.

EXAMPLE 4

The experiment described in Example 3 was repeated on a different day when the mineralogical compositions of the various fractions were slightly different.

The results obtained are set forth in the following Table III:

TABLE III

| | Density separating vessel | | | 250 μm screen | |
|---|---|---|---|---|---|
| | Feed | Over-flow | Under-flow | Re-tained | Passed |
| % by wt. of dry material relative to original dry feed material | 100 | 70 | 30 | 21 | 49 |
| % by wt. of following constituents in dry material at different | | | | | |

TABLE III-continued

| | Density separating vessel | | | 250 μm screen | |
|---|---|---|---|---|---|
| | Feed | Over-flow | Under-flow | Re-tained | Passed |
| stages:- | | | | | |
| kaolinite | 29 | 40 | 3 | 25 | 46 |
| mica | 25 | 28 | 18 | 54 | 17 |
| quartz | 44 | 29 | 79 | 21 | 32 |
| feldspar | 2 | 3 | 0 | 0 | 5 |
| tourmaline | 0 | 0 | 0 | 0 | 0 |
| % by wt. recovery of following constituents at different stages:- | | | | | |
| mica | 100 | 78 | 22 | 45 | 33 |
| quartz | 100 | 46 | 54 | 10 | 36 |
| kaolinite | 100 | 96.5 | 3.5 | 18 | 78.5 |

In this case the feed to the froth flotation process was a mineral mixture 54% of dry weight of which consisted of mica; thus 45% by weight of the original mica was recovered for use in the feed to the froth flotation process.

I claim:

1. A process for concentrating mica in a particulate mixture of sand and mica, which process comprises introducing the feed mixture of sand and mica into an upper part of a density separating vessel in which is provided a rising current of an aqueous medium introduced at a level below that at which the feed mixture is introduced, the velocity of the rising current being uniform or substantially uniform over a horizontal cross-section of the vessel and being such that all but the least buoyant particles of the mixture are held in suspension as a quiescent bed which is gently displaced upwards in the vessel by incoming feed mixture, there being only slight horizontal movement of the particles in the bed across the vessel; and passing a slurry which overflows from the vessel over a screen having an aperture size in the range from 210 μm to 500 μm (No. 72 mesh to No. 30 mesh B.S. sieve), there being retained on the screen a mixture of sand and mica having a higher percentage content of mica, as calculated in the dry state, than the feed mixture.

2. A process according to claim 1, wherein the mixture of sand and mica is introduced into the density separating vessel in a form selected from the group consisting of the dry state and a suspension in water.

3. A process according to claim 1, wherein the slurry which overflows from the vessel passes over an overflow weir, and wherein a slurry of least buoyant particles is discharged through an outlet in a lower part of the vessel.

4. A process according to claim 3, wherein the rate at which the slurry of least buoyant particles is discharged through the outlet in the lower part of the vessel is controlled by monitoring the hydrostatic pressure of the contents of the vessel at a given level in the vessel, and by opening/closing the outlet to keep the monitored hydrostatic pressure at a value selected from the group consisting of a constant value and a value within a predetermined range.

5. A process according to claim 1, wherein the aqueous medium is water introduced through perforations in the lower side of pipes disposed as a horizontal array in a low region of the vessel.

6. A process according to claim 1, wherein the mixture of sand and mica is introduced into the vessel as an aqueous suspension fed tangentially into a feed chamber provided on the vertical axis of the vessel, the feed chamber being open at its bottom and being provided in its bottom region with baffles to destroy any circular component of velocity of the feed mixture.

7. A process according to claim 1, wherein the slurry which overflows from the vessel is passed over a screen having an aperture size in the range from 250 to 350 μm (No. 60 mesh to No. 44 mesh B.S. sieve).

* * * * *